US005866864A

United States Patent [19]

Mody et al.

[11] Patent Number: 5,866,864

[45] Date of Patent: Feb. 2, 1999

[54] ELECTRIC CURRENT SWITCHING APPARATUS WITH ARC SPINNING EXTINGUISHER

[75] Inventors: Hemant K. Mody; James C. Vander Meer; Slobodan Krstic, all of Brookfield; Peter K. Moldovan, Cascade, all of Wis.

[73] Assignee: Eaton Corporation, Cleveland, Ohio

[21] Appl. No.: 891,970

[22] Filed: Jul. 14, 1997

[51] Int. Cl.[6] ..... H01H 33/18; H01H 9/44

[52] U.S. Cl. ..... 218/38; 218/149; 335/201

[58] Field of Search ..... 218/38, 29, 149, 218/150–158, 15, 8, 144 R, 147 R, 144 C, 51, 81, 82; 355/201, 247

[56] References Cited

U.S. PATENT DOCUMENTS

| | | | |
|---|---|---|---|
| 2,051,478 | 8/1936 | Hampton et al. . | |
| 2,596,865 | 5/1952 | Peter . | |
| 2,632,074 | 3/1953 | Herman | 200/144 |
| 3,126,464 | 3/1964 | Stettner | 200/144 |
| 3,629,533 | 12/1971 | Kuznestov et al. | 200/144 R |
| 4,041,356 | 8/1977 | Buisson et al. | 361/14 |
| 4,056,798 | 11/1977 | Malick . | |
| 4,079,219 | 3/1978 | Weston . | |
| 4,258,345 | 3/1981 | Malick | 335/201 |
| 4,376,271 | 3/1983 | Gallatin et al. | 335/159 |
| 4,539,451 | 9/1985 | Mori et al. . | |
| 4,568,805 | 2/1986 | Wycklendt | 200/147 R |
| 4,568,907 | 2/1986 | Hurtle | 338/61 |
| 5,004,874 | 4/1991 | Theisen et al. . | |
| 5,138,122 | 8/1992 | Moldovan et al. . | |
| 5,416,455 | 5/1995 | Moldovan et al. . | |

*Primary Examiner*—Lincoln Donovan
*Assistant Examiner*—Lee S. Lum
*Attorney, Agent, or Firm*—Quarles & Brady

[57] ABSTRACT

An electric arc extinguishing mechanism is provided for an electric current switching apparatus of the type having a pair of contacts which selectively engage to complete an electric circuit. The mechanism includes a plurality of splitter plates located adjacent to the contacts and formed of electrically conductive material. Each splitter plate has a body of electrically conductive material, and a casing with a pair of planar portions on opposite sides of the body and connected by the curved edge portion. The edge portion is adjacent the contacts with the planar portions extending from the edge portion in an open loop having a gap. Any arc introduced between adjacent splitter plates moves around the open loop before being extinguished thereby not residing in one spot long enough to cause gross melting and associated erosion of the splitter plate.

18 Claims, 3 Drawing Sheets

ELECTRIC CURRENT SWITCHING APPARATUS WITH ARC SPINNING EXTINGUISHER

BACKGROUND 0F THE INVENTION

This invention relates to apparatus for switching electric current, such as direct current (DC) electricity; and more particularly to such apparatus which has a mechanism for extinguishing arcs formed between switch contacts during separation.

DC electricity is used in a variety of applications such as battery powered systems, drives for motors and DC accessory circuits, in which contactors are used to make and break load current. Weight, reliability and high DC voltage switching and interrupting capability are important considerations in developing the contactor. Furthermore, in many applications relatively large direct currents must be switched which produce arcs when the contacts of the contactor separate, thereby requiring a mechanism for extinguishing the arcs.

Previous DC contactors and switches incorporated one or more arc extinguishing chambers, often referred to as "arc chutes" such as described in U.S. Pat. No. 5,416,455, to extinguish arcs that formed between the switch contacts. Arc extinguishing chambers may comprise a series of spaced apart electrically conductive splitter plates. In DC switching devices, permanent magnets on the sides of the series of splitter plates establish a magnetic field across the arc extinguishing chamber which directs arcs into the splitter plate arrangement. The arc then propagates from one splitter plate to another in the series and eventually the arc spans a number of gaps between the splitter plates whereby sufficient arc voltage is built up that the arc is extinguished.

The arc in DC switching devices can be stabilized in one spot on a given splitter plate. This concentration of energy at one spot erodes the metal plate, particularly when the arc duration is relatively long as occurs with inductive loads.

SUMMARY OF THE INVENTION

A general object of the present invention is to provide a current switching apparatus incorporating a mechanism that extinguishes arcs which form when the switch contacts separate.

Another object is to reduce arc induced erosion of components of the extinguishing mechanism.

A further object of the present invention is to provide such erosion reduction by inducing movement of the arc across surfaces of splitter plates within the arc extinguishing mechanism.

These and other objects are fulfilled by an arc extinguishing mechanism for an electric current switching apparatus of the type having first and second contacts which selectively engage each other to complete an electric circuit. The arc extinguishing mechanism includes a plurality of electrically conductive splitter plates located adjacent to the first and second contacts, preferably in a stack with major surfaces of one splitter plate facing a major surface of an adjacent splitter plate. Each major surface has an open loop with a gap, wherein an arc formed between adjacent splitter plates moves around the loop. In circuits involving longer interruption times, the arc jumps across the gap and repeats its motion before being extinguished.

In the preferred embodiment, each splitter plate comprises casing of electrically conductive material formed by a pair of spaced planar portions connected by an edge portion that faces the first and second contacts. Each of the planar portions has a distal section which is contiguous with and extends from the edge portion, and has a curved section contiguous with and extending from the distal section in a curve which forms the loop. The curved section terminates at an end which is spaced from the distal section to form the gap. Preferably, the edge portion of the casing has a convex shape curving away from the planar portions toward the first and second contacts.

Because the arc moves continuously around the loop of each splitter plate, the arc roots do not reside in one spot long enough to cause gross melting and associated erosion of the splitter plates, thus resulting in longer device life.

DETAILED DESCRIPTION OF THE INVENTION

Figure 1:
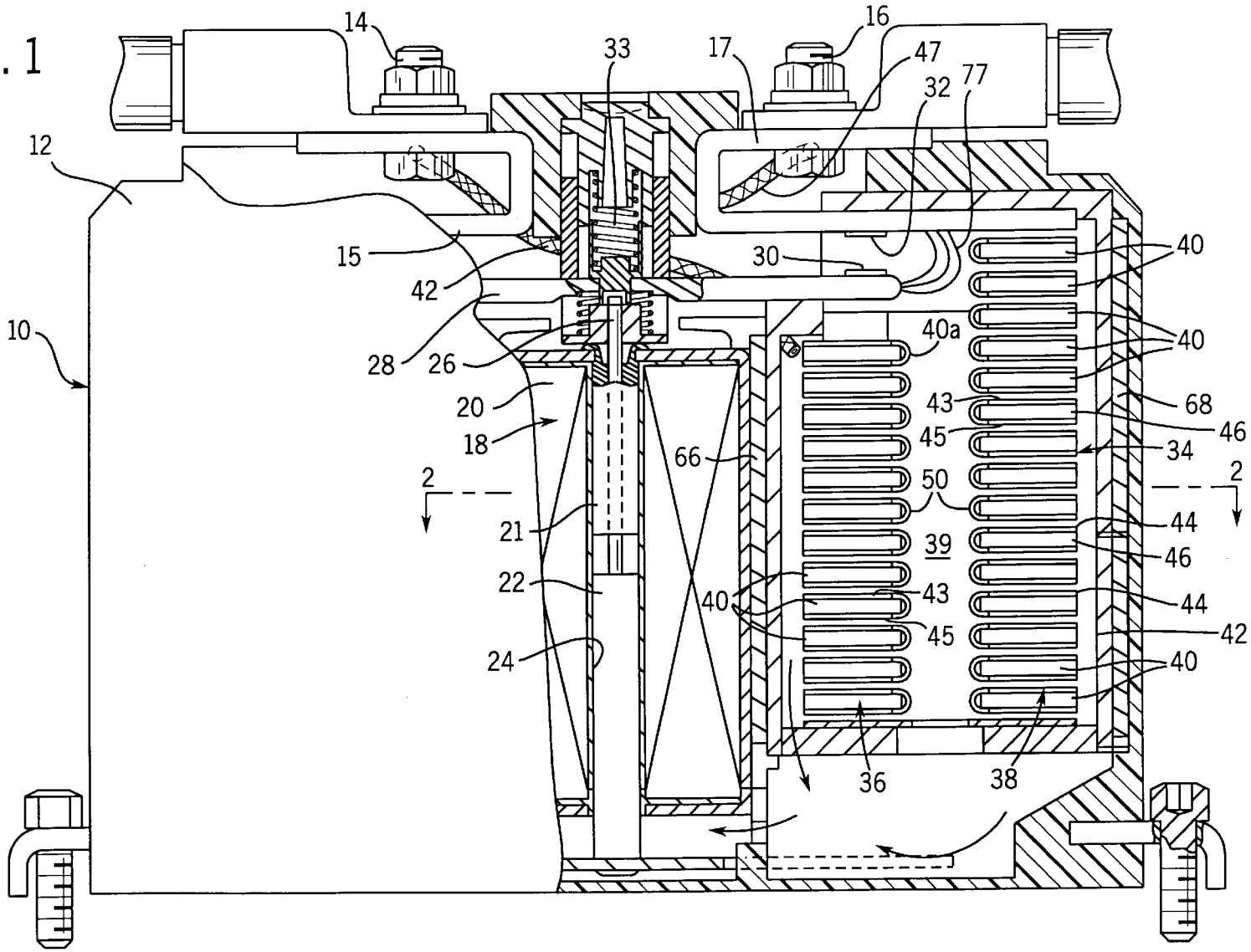
FIG. 1 is a cut away view of a DC contactor which incorporates an arc extinguishing chamber according to the present invention.

With reference to FIG. 1, a sealed electromagnetic single pole contactor 10 has a plastic housing 12 with first and second power terminals 14 and 16. The first power terminal 14 is connected to a first stationary contact 15 attached to the housing and the second power terminal 16 is connected to a second stationary contact 17.

An electromagnetic solenoid 18 nests in recesses in the interior surfaces of the housing 12. The solenoid 18 has an annular coil 20, a core 21 and an armature 22 located within the central opening 24. The armature 22 includes a shaft 26 that passes through the core 21 and connects to a moveable contact arm 28, which in the closed state of the contactor bridges the stationary contacts 15 and 17 completing an electrical path between the power terminals 14 and 16. Each end of the moveable contact arm 28 has a contact pad 30 which in the closed state abuts a mating contact pad 32 on the stationary contact 15 or 17 associated with that end of the moveable contact arm. A spring assembly 33 biases the moveable contact arm 28 and the armature 22 so that the contactor 10 is in a normally open position when the solenoid coil 20 is deenergized, as illustrated in FIG. 1.

Each end of the moveable contact arm 28 extends into a separate arc extinguishing chamber. The two arc extinguishing chambers are mirror images of each other with one chamber 34 visible in FIG. 1. Arc extinguishing chamber 34 is formed by two stacks 36 and 38 of spaced apart splitter plates 40 with a region 39 between the stacks. Note that the top splitter plate in the inner stack 36 is connected by a wire braid to the other power terminal than the one that the stack is beneath. For example, the top splitter plate **40*a* in the inner stack 36 beneath the second power terminal 16 is connected by a wire braid 42 to the first power terminal 14. Another wire braid 47 connects a splitter plate of the arc extinguishing chamber beneath the first power terminal 14 to the second power terminal 16**.

Figure 2:
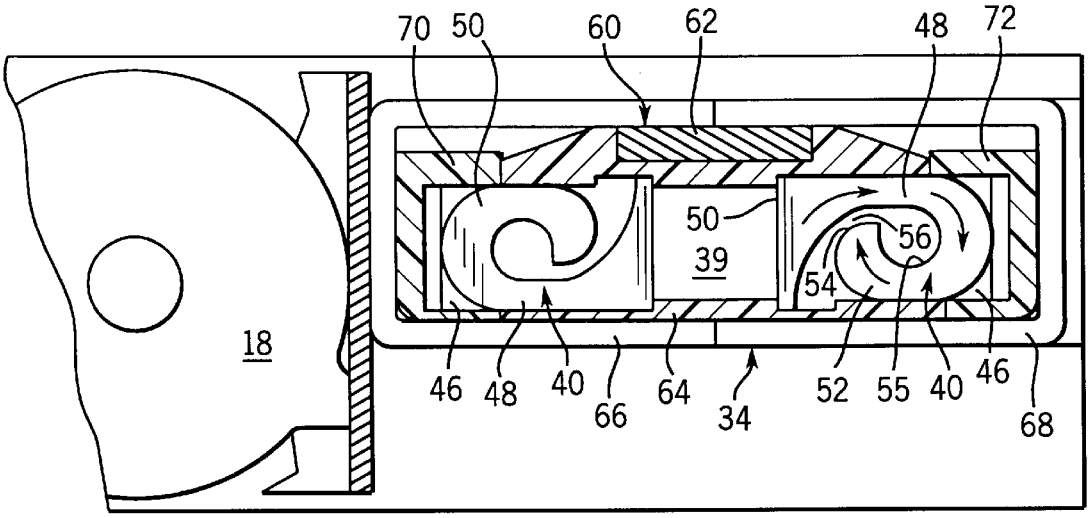
FIG. 2 is a cross-sectional view of the extinguishing chamber along lise 2—2 in FIG. 1.

Referring to FIGS. 1 and 2, each splitter plate 40 has an outer U-shaped casing 44 with a pair of identical planar legs 43 and 45 connected by a curved edge 50. The curved edge 50 of each splitter plate 40 faces the center region 39 of the arc extinguishing chamber 34. The planar legs 43 and 45 of the splitter plates 40 are identical and have a curved shape resembling the mirror image of the arabic numeral 9, in the orientation shown in FIG. 2. Specifically, each leg 43 and 45 has a distal section 48 projecting from one side of the curved edge 50 and tapering to one lateral side of the splitter plate 40. The distal section 48 transforms into a curved section 52 which bends back around toward itself terminating at an edge 54 which is spaced from the distal section 48 by a gap 56. The distal and curved sections 48 and 52 form an open loop with an inner diametric aperture 55.

The casing 44 of each splitter plate 40 is formed of an electrically conductive material, such as copper, and extends around a magnetic body 46 such as steel. This body 46 nests within the opening of the U-shaped casing 44 and has a rectangular shape with outer dimensions that correspond to those of the casing interior.

Because the contactor 10 switches direct current, a magnetic field is employed to move electric arcs into the arc extinguishing chamber 34. Referring to FIG. 2, that magnetic field is produced across center region 39 of arc extinguishing chamber 34 by a permanent magnet assembly 60. This assembly comprises a permanent magnet 62 located outside the plastic housing 64 of the arc extinguishing chamber 34 along the height of that chamber. The permanent magnet 62 is magnetically coupled to a pair of iron, U-shaped members 66 and 68 that abut the outside surface of this magnet and extend around opposite sides of the arc extinguishing chamber 34. A pair of plastic brackets 70 and 72 hold the splitter plates 40 and 42 in notches of the plastic housing 64 and close that housing. The coupling of permanent magnet 62 with U-shaped members 66 and 68 establishes a magnetic field across the arc-extinguishing chamber 34 (vertically in FIG. 2), which directs electric arcs formed between the contact pads 30 and 32 toward the splitter plates 40, as will be described.

With reference to FIG. 1, when the contactor 10 opens, the armature 22 and the attached contact arm 28 move away from the stationary contacts 15 and 17 which causes the contact pads 30 and 32 to separate and move into the position shown. As the contact pads 30 and 32 separate, an arc 77 may form there between. The force produced by the interaction of the arc current with the magnetic field from the permanent magnet 62 (FIG. 2) causes the arc 77 to move from contact pad 32 outward along the stationary contact 17 toward the outside stack 38 of splitter plates in arc extinguishing chamber 34. At the same time, the arc 77 moves off the other contact pad 30 onto the tip of the moveable contact arm 28.

The arc 77 propagates along the stationary contact 17 and onto the top splitter plate 40 in the outer stack 38. The arc then bridges the vertical gaps between adjacent splitter plates 40 in the outer stack 38. Eventually the arc 77 travels down the outer stack 38 to the point where the other end of the arc travels onto the top splitter plate 40*a* in the inner stack 36. When the arc 77 attaches to the top plate 40*a* in the inner stack 36, the arc in the other arc extinguishing chamber for stationary contact 15 is shorted out and fully extinguished because of the connection of that top plate 40*a* to the opposite power terminal 14 by wire braid 42.

However, arc 77 is not extinguished at that time and continues propagating further downward onto each subsequent splitter plate 40 in stacks 36 and 38. This action forms a separate sub-arc in the vertical gaps between adjacent splitter plates 40. Eventually the arc 77 spans a sufficient number of gaps between the splitter plates, building up significant arc voltage and extinguishing the arc.

Once the arc is established between adjacent splitter plates 40, it experiences a Lorentz force that causes movement from adjacent the curved edge 50 along the distal and curved sections 48 and 52 as indicated by arrows in FIG. 2. Upon reaching the edge 54 at the end of curved section 52, the arc jumps the gap 56 back onto the distal section 48 and repeats the circular movement. Because the arc moves continuously across the surfaces of the splitter plates 40, the arc roots do not reside in one spot long enough to cause gross melting and associated erosion of the splitter plates, thus resulting in longer device life. In addition, the arc movement enables the contactor to tolerate longer interruption times associated with long time constant DC interruption. The Lorentz force experienced by the arc is enhanced by the magnetic steel body 46 disposed between legs 43 and 45 of casing 44.

Figure 4:
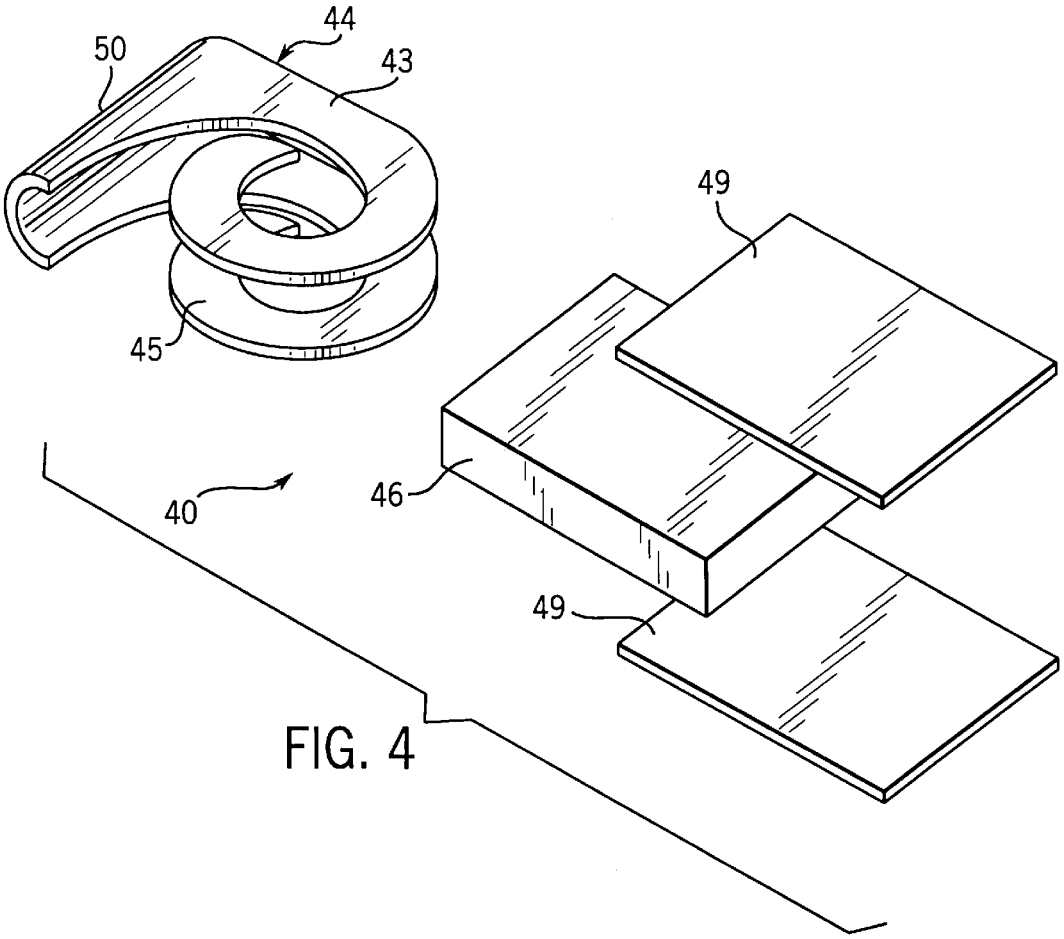
FIG. 4 is an exploded isometric view of the splitter plate according to the present invention.
Figure 5:
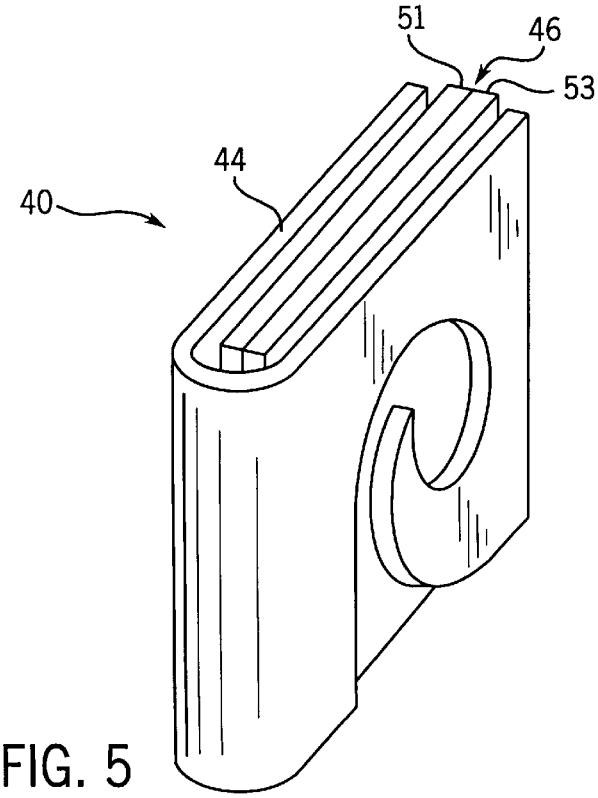
FIG. 5 is an isometric view of an alternative embodiment of the splitter plate.

To prevent the arc from shorting through the magnetic steel body 46, the body can be electrically insolated by inserting insulating sheets 49 on either side of body 46 as shown in FIG. 4, or by coating body 46 with an insulating material. As another alternative, the body 46 may comprise two magnetic steel sheets 51 and 53 as shown in FIG. 5. Thus even through the steel sheets 51 and 53 are physically touching each other and the casing 44, air gaps between each steel sheet and the casing and between the two steel sheets provide sufficient resistance that the arc current does not flow through the body 46. Instead the arc current flows through the copper casing 44, the path of least resistance. As a result, the steel sheets 51 and 53 act as a current self-field concentrator that maximizes the Lorentz force on the arc roots which facilitates arc splitting and spinning.

Figure 3:
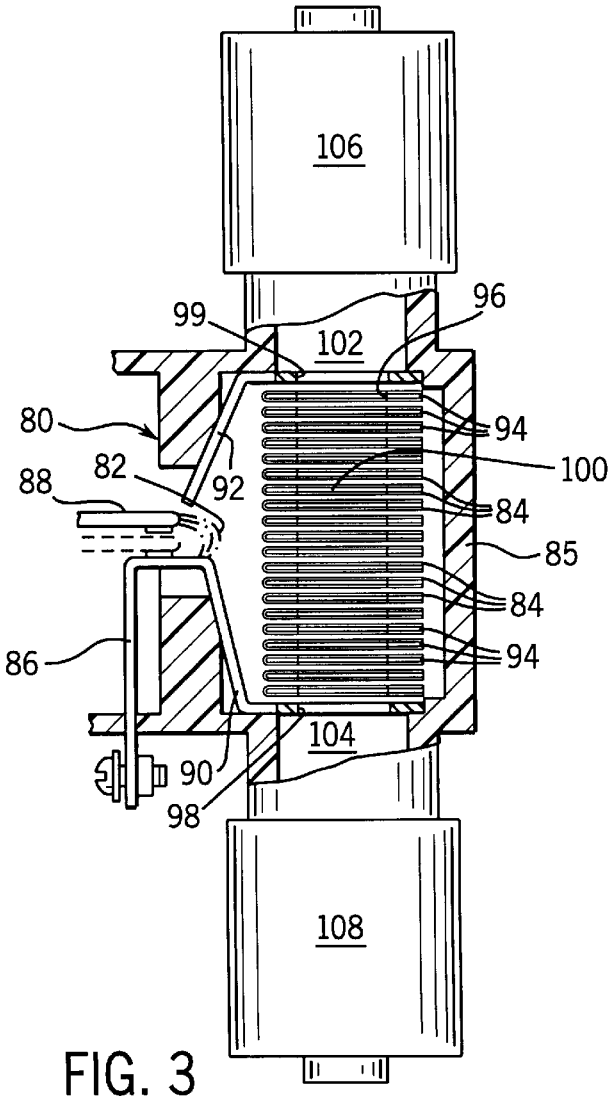
FIG. 3 is a cross-sectional view of another embodiment of an extinguishing chamber according to the present invention.

FIG. 3 shows another version of an arc extinguishing chamber 80 that incorporates the present invention. In this arrangement the arc 82 enters the chamber 80 in the mid point of a single stack of splitter plates 84 contained in the interrupter housing 85. Specifically the arc 82 is formed between a stationary contact 86 and a moveable contact 88. The stationary contact 86 is integrated with a lower arc runner 90 to form a single piece structure wherein the lower arc runner extends beneath the stack of splitter plates 84. An upper arc runner 92 is adjacent to yet separated from the moveable contact 88 and extends above the stack of splitter plates 84.

Each splitter plate 84 is similar in design to splitter plates 40 of the embodiment in FIGS. 1 and 2. Specifically, each splitter plate 84 has an outer U-shaped casing 44 with a closed curved edge facing the two contacts 86 and 88 with a magnetic steel body 94 located within the U-shaped casing. In the second version, each body 94 has an aperture 96 therethrough which is sized and aligned to correspond to the aperture 55 in the loop of the associated splitter plate 84. The two arc runners 90 and 92 have similarly aligned apertures 98 and 99, respectively. As a consequence, a central passage 100 is created through the stack of splitter plates 84 and bodies 94. This central passage 100 opens into exhaust passages 102 and 104 formed in the contactor housing 85 above and below the splitter plates 84, respectively.

In many applications, the exhaust passages 102 and 104 can be vented directly to the exterior of the housing 85 with appropriate safeguards, such as screens, to prevent external objects from coming into contact with electrical conducting members of the contactor. In other applications, such as military equipment, where noise is a concern, mufflers 106 and 108 can be attached to the outlet openings of the exhaust passages 102 and 104. Each muffler 106 and 108 may be similar in design to those used on single cylinder internal combustion engines, for example mufflers manufactured by Nelson Mufflers of Stoughton, Wis., U.S.A. The design considerations are similar to those for engine mufflers and involve a trade-off between sufficiently baffling and extending the air path of the exhaust gases to deaden the sound caused by the arc and permitting sufficient air flow through the muffler so as not to impede movement of the arc within the chamber.

We claims:

1. An electric arc extinguishing mechanism comprising a plurality of splitter plates arranged side-by-side, each of the plurality of splitter plates comprises:

a casing of electrically conductive material having a pair of spaced apart legs connected by an edge portion, wherein each of the spaced apart legs extends from the edge portion in an open loop with the gap; and a body of magnetic material disposed between the spaced apart legs.

2. The electric arc extinguishing mechanism as recited in claim 1, wherein the casing is made of non-magnetic material.

3. The electric arc extinguishing mechanism as recited in claim 2 wherein the casing is made of copper.

4. The electric arc extinguishing mechanism as recited in claim 1 wherein an arc introduced between adjacent ones of the plurality of splitter plates repeatedly moves around the open loop jumping the gap before being extinguished.

5. The electric arc extinguishing mechanism as recited in claim 1 wherein each of the spaced apart legs comprises:

a distal section contiguous with and extending from the edge portion; and a curved section contiguous with and extending from the distal section in a curve which forms the open loop, and having an end spaced from the distal section to form the gap.

6. The electric arc extinguishing mechanism as recited in claim 1 wherein the edge portion of the casing has a convex shape curving away from the spaced apart legs.

7. The electric arc extinguishing mechanism as recited in claim 1 wherein the body is steel and the casing is copper.

8. The electric arc extinguishing mechanism as recited in claim 1 wherein each of the plurality of splitter plates comprises electrical insulating material disposed between the body and the casing.

9. The electric arc extinguishing mechanism as recited in claim 1 wherein the body comprises a plurality of steel sheets abutting each other and disposed between the spaced apart legs.

10. The electric arc extinguishing mechanism as recited in claim 1 further comprising a housing around the plurality of splitter plates and having an opening through which gases from the arc can escape from the housing.

11. The electric arc extinguishing mechanism as recited in claim 10 further comprising a muffler communicating with the opening to deaden sound produced by an arc within the housing.

12. The electric arc extinguishing mechanism as recited in claim 10 wherein the plurality of splitter plates have apertures through which gases from the arc flow to the opening.

13. An electric arc extinguishing mechanism for an electric current switching apparatus of the type having first and second contacts which selectively engage each other to complete an electric circuit, said arc extinguishing mechanism comprising:

a plurality of splitter plates located adjacent to the first and second contacts and formed of electrically conductive material, each of the plurality of splitter plates having a body of magnetic material, and a casing with a pair of planar portions on opposite sides of the body and connected by an edge portion adjacent the first and second contacts, each of the planar portions extending from the edge portion in an open loop having a gap; wherein an arc introduced between adjacent ones of the plurality of splitter plates moves around the open loop before being extinguished.

14. The electric arc extinguishing mechanism as recited in claim 10 wherein each of the planar portions comprises:

a distal section contiguous with and extending from the edge portion; and a curved section contiguous with and extending from the distal section in a curve which forms the open loop, and having an end spaced from the distal section to form the gap.

15. The electric arc extinguishing mechanism as recited in claim 13 wherein the casing is made of an electrically conductive, non-magnetic material.

16. An electric arc extinguishing splitter plate comprising electrically conductive material and having two lateral portions spaced apart and connected by an edge portion, each lateral portion extending from the edge portion in an open loop having a gap.

17. The electric arc extinguishing splitter plate as recited in claim 16 wherein each of the two lateral portions has a distal section contiguous with and extending from the edge portion; and a curved section contiguous with and extending from the distal section in a curve which forms the open loop, and having an end spaced from the distal section to form the gap.

18. The electric arc extinguishing splitter plate as recited in claim 16 farther comprising a body of magnetic material disposed between the lateral portions.

* * * * *